US010415799B1

(12) United States Patent
Grove et al.

(10) Patent No.: US 10,415,799 B1
(45) Date of Patent: Sep. 17, 2019

(54) DUAL OUTPUT DOWNLIGHT FIXTURE

(71) Applicant: ABL IP Holding LLC, Decatur, GA (US)

(72) Inventors: Douglas Grove, Grayson, GA (US); Peter K. Nelson, Denver, CO (US); Carl T. Gould, Golden, CO (US); Joshua J. Miller, Highlands Ranch, CO (US); Kevin F. Leadford, Evergreen, CO (US); Christopher D. Slaughter, Littleton, CO (US); Christopher J. Sorensen, Denver, CO (US)

(73) Assignee: ABL IP Holding LLC, Atlanta, GA (US)

( * ) Notice: Subject to any disclaimer, the term of this patent is extended or adjusted under 35 U.S.C. 154(b) by 187 days.

(21) Appl. No.: 15/392,609

(22) Filed: Dec. 28, 2016

Related U.S. Application Data

(60) Provisional application No. 62/272,225, filed on Dec. 29, 2015.

(51) Int. Cl.
*F21V 14/06* (2006.01)
*F21V 11/00* (2015.01)
(Continued)

(52) U.S. Cl.
CPC ..... *F21V 14/06* (2013.01); *F21S 8/026* (2013.01); *F21V 3/00* (2013.01); *F21V 11/00* (2013.01); *F21V 15/01* (2013.01); *F21Y 2115/10* (2016.08)

(58) Field of Classification Search
CPC ..... F21S 8/026
(Continued)

(56) References Cited

U.S. PATENT DOCUMENTS 5,662,403 A * 9/1997 Akashi ..... F21S 8/02 362/292
5,810,469 A * 9/1998 Weinreich ..... F21V 7/09 362/298

(Continued)

OTHER PUBLICATIONS

3" Duo—Dual-source LED downlight, WAC Lighting Co., http://www.waclighting.com/product/3133, retrieved from the internet on May 2, 2016 (1 Page).

(Continued)

*Primary Examiner* — Alexander K Garlen
*Assistant Examiner* — Eric T Eide
(74) *Attorney, Agent, or Firm* — Kilpatrick Townsend & Stockton LLP

(57) ABSTRACT

A dual output downlight luminaire includes a housing that forms at least a first cavity. A partition extends from a portion of the housing and at least partially forms a boundary between the first cavity and an annular second cavity. A first light source emits a first light that is centered about an optical axis and propagates toward a first output aperture. An optic redirects the first light to form a first light beam that exits the luminaire through the first output aperture. A concentrated portion of the first light beam subtends an angle of 60 degrees or less and is centered about the optical axis. A plurality of second light sources, within the second cavity, emit a second light that exits the luminaire through an annular second output aperture. The first and second light sources are independently controllable with respect to each other.

25 Claims, 13 Drawing Sheets

(51) Int. Cl.

| | |
|---|---|
| ***F21V 3/00*** | (2015.01) |
| ***F21S 8/02*** | (2006.01) |
| ***F21V 15/01*** | (2006.01) |
| *F21Y 115/10* | (2016.01) |

(58) Field of Classification Search
USPC ..... 362/304, 305
See application file for complete search history.

(56) References Cited

U.S. PATENT DOCUMENTS

| | | | | |
|---|---|---|---|---|
| 7,014,341 | B2 | 3/2006 | King et al. | |
| 7,476,008 | B2 | 1/2009 | Kay | |
| 7,588,347 | B1 * | 9/2009 | Edwards, Jr. | F21S 8/04 362/225 |
| 7,828,461 | B2 * | 11/2010 | Mayer | F21S 8/086 362/241 |
| 8,100,557 | B2 * | 1/2012 | Chen | F21S 8/06 362/249.02 |
| 8,425,085 | B2 * | 4/2013 | Van Laanen | F21V 29/507 362/294 |
| 8,439,526 | B2 * | 5/2013 | Brusilovsky | F21S 6/003 362/304 |
| 10,041,635 | B2 * | 8/2018 | Lam | F21L 4/027 |
| 2007/0285921 | A1 * | 12/2007 | Zulim | F21S 2/00 362/240 |
| 2009/0175040 | A1 * | 7/2009 | Green | F21S 8/02 362/294 |
| 2012/0320588 | A1 * | 12/2012 | Quilici | F21S 8/026 362/249.02 |
| 2016/0195245 | A1 * | 7/2016 | Markey | F21V 14/04 362/147 |

OTHER PUBLICATIONS

CircLet—Wila, http://www.wila.com/en/products/product-families/circlet/, retrieved from the internet on May 2, 2016 (4 pages).

* cited by examiner

FIG. 8B
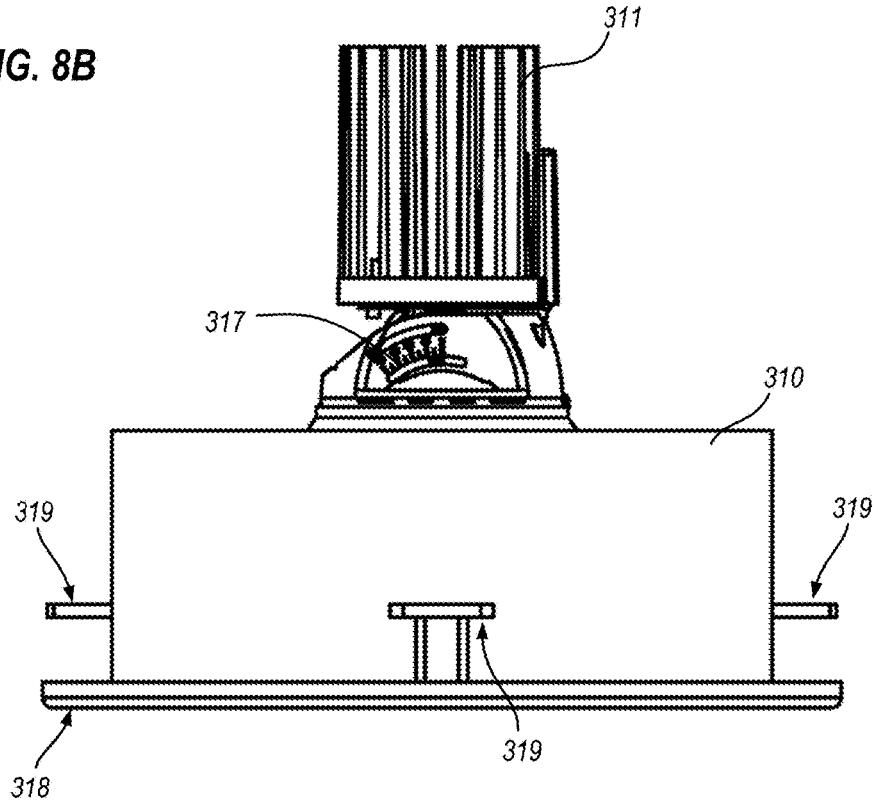
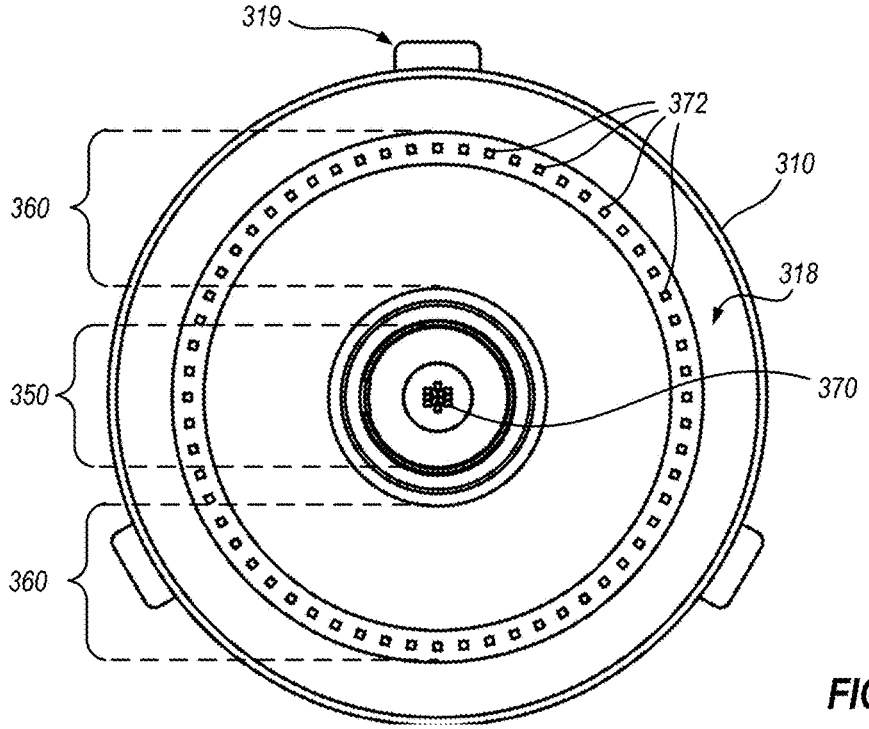
FIG. 8C

DUAL OUTPUT DOWNLIGHT FIXTURE

CROSS-REFERENCE TO RELATED APPLICATIONS

This application is a non-provisional application of, and claims priority to, U.S. Provisional Patent Application Ser. No. 62/272,225, filed 29 Dec. 2015, which is incorporated by reference herein in its entirety.

BACKGROUND

Lighting that provides general illumination to a space is often referred to as ambient lighting, while lighting that provides illumination to very specific regions is often referred to as task lighting. Certain lighting systems provide lighting in a spatial distribution that is somewhat localized, but remains much like ambient lighting in overall character. Examples of this include light fixtures often called "downlights" that are typically installed as a recessed fixture in a ceiling, and provide light that is generally directed downward. However, downlights usually do not limit the light emitted to as specific of an area as is usually associated with task lighting. Also, whether based on incandescent or compact fluorescent light sources (CFLs), downlights that are based on sources that are about the size of A-series Edison screw bases are necessarily somewhat large in size. Edison screw bases smaller than 12 mm diameter are typically only utilized for decorative or indicator purposes. Standard A-series sockets are a minimum of 26 mm in diameter, and the associated light bulbs are typically several times longer than the width of the base.

SUMMARY

In an embodiment, a dual output downlight luminaire includes an outer housing that forms at least a first cavity, a partition that extends from a portion of the housing and at least partially bounds an annular second cavity, a first light source and a plurality of second light sources. The first light source emits a first light that is centered about an optical axis and propagates toward a first output aperture. An optic redirects the first light to form a first light beam that exits the luminaire through the first output aperture; a concentrated portion of the first light beam subtends an angle of 60 degrees or less and is centered about the optical axis. A plurality of second light sources are disposed within the second cavity, and emit a second light that exits the luminaire through an annular, second output aperture. The first and second light sources are independently controllable with respect to each other.

In an embodiment, a dual output downlight luminaire includes a housing that forms at least a first cavity. A partition extends from a portion of the housing and at least partially forms a boundary between the first cavity and an annular second cavity. A first light source emits a first light that is centered about an optical axis and propagates toward a first output aperture. An optic redirects the first light to form a first light beam that exits the luminaire through the first output aperture. A concentrated portion of the first light beam subtends an angle of 60 degrees or less and is centered about the optical axis. A plurality of second light sources, within the second cavity, emit a second light that exits the luminaire through an annular second output aperture. The first and second light sources are independently controllable with respect to each other.

In an embodiment, a method provides one or both of task and ambient lighting using a single luminaire. The method includes emitting a first light from a first light source toward a first output aperture of the single luminaire. A light emission direction of the first light from a centroid of the first light source toward a centroid of the first output aperture defines an optical axis. The method further includes redirecting the first light with an optic to form a first light beam that exits the luminaire through the first output aperture. A concentrated portion of the first light beam subtends an angle of 60 degrees or less, and is centered about the optical axis. The method further includes emitting a second light from a plurality of second light sources toward an annular second output aperture of the single luminaire. The second output aperture azimuthally surrounds the first output aperture. The method further includes independently controlling the first light source and the second light sources, such that the first light beam is available when desired for task lighting and the second light is available when desired for ambient lighting.

BRIEF DESCRIPTION OF THE DRAWINGS

The present disclosure is described in conjunction with the appended figures:

FIG. 8B is a front elevation of the dual output downlight fixture of FIG. 8A.

FIG. 8C is a bottom plan view of the dual output downlight fixture of FIG. 8A.

DETAILED DESCRIPTION

Figure 1:
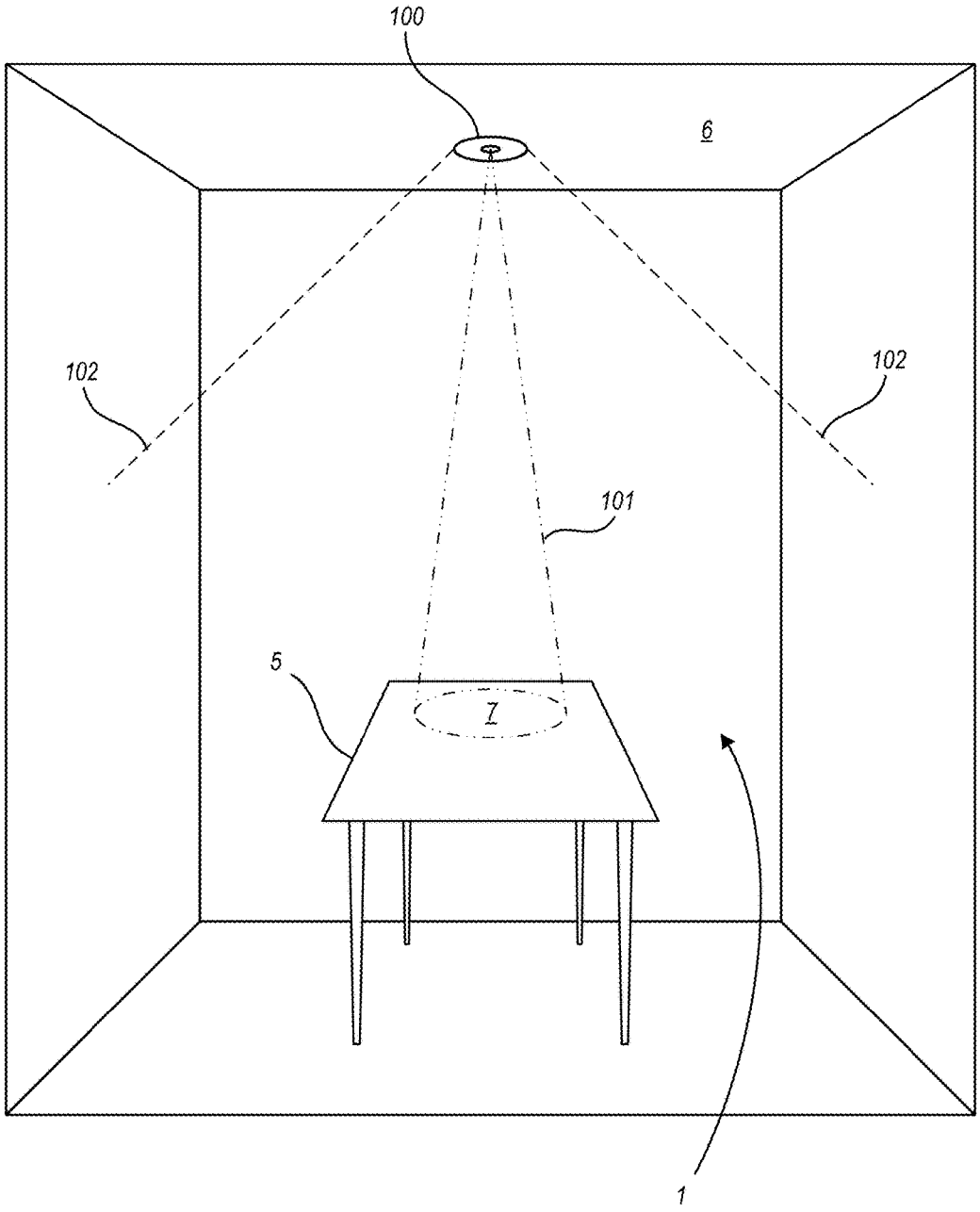
FIG. 1 illustrates a space that is illuminated by a dual output downlight fixture, in accord with an embodiment.

The present disclosure may be understood by reference to the following detailed description taken in conjunction with the drawings described below, wherein like reference numerals are used throughout the several drawings to refer to similar components. It is noted that, for purposes of illustrative clarity, certain elements in the drawings may not be drawn to scale. Specific instances of an item may be referred to by use of a numeral followed by a dash and a second numeral (e.g., downlight fixtures 100-1, 100-2 etc.) while numerals not followed by a dash refer to any such item (e.g., downlight fixture 100). Also, congruently numbered items (e.g., designated with numerals in the forms 1XX, 2XX or 3XX where XX are the same) are similar in function to, but may have different structural and/or functional details compared to one another. Where multiple instances of an item are shown, only some of the instances may be labeled, for clarity of illustration.

Light-emitting diodes (LEDs) are increasingly being deployed as illumination sources. They are not only as efficient as CFLs and highly reliable, but can provide large amounts of light from very small packages. Due to their high reliability, LEDs are often deployed as permanent parts of a light fixture, obviating the need for sockets and bases. Thus, light fixtures and optics to direct the emitted light can be smaller than would be needed for light sources based on typical incandescent, fluorescent and high intensity discharge (HID) sources.

Embodiments herein provide new and useful dual output downlight fixtures and methods. Several embodiments are contemplated and will be discussed, but embodiments beyond the present discussion, or intermediate to those discussed herein, are within the scope of the present application.

FIG. 1 illustrates a space 1 that is illuminated by a dual output downlight fixture 100. Within space 1, an exemplary piece of furniture 5 presents an area 7 where task lighting might be desired. Dual output downlight fixture 100 couples within ceiling 6 of space 1, and provides both task light 101 that illuminates area 7, and ambient light 102 that illuminates much of space 1 (ambient light 102 fills the area within the broken lines labeled 102). It should be understood that the boundaries illustrated for both task light 101 and ambient light 102 are only suggested by the lines shown; such boundaries may vary in size or position, and may not be sharp boundaries at all but rather indicate the general location of diffuse or gradient boundaries. Modalities for providing dual output downlight fixture 100 are now discussed.

Figure 2:
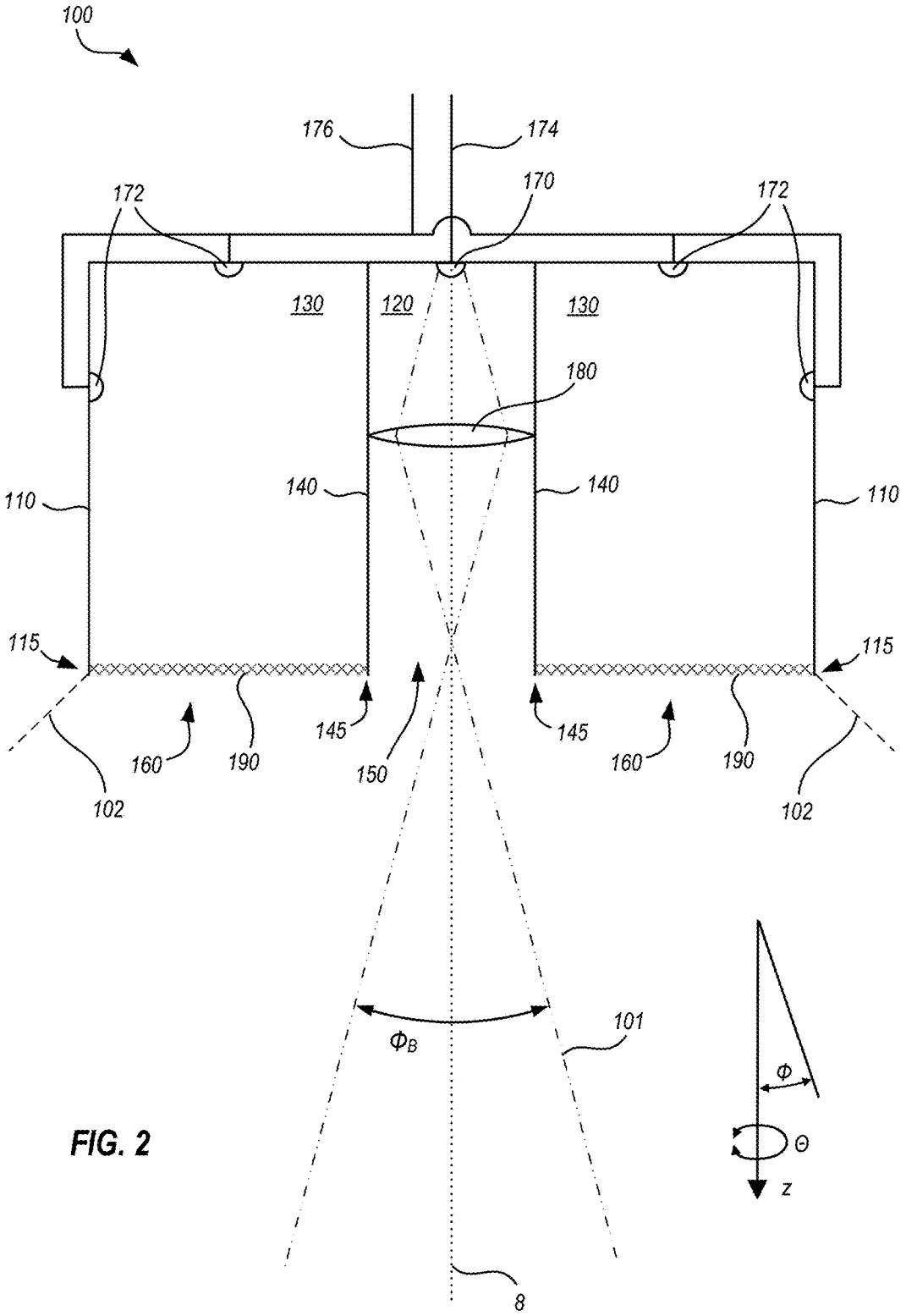
FIG. 2 is a generalized schematic cross-sectional diagram illustrating a dual output downlight fixture, in accord with an embodiment, that represents an example of the dual output downlight fixture of FIG. 1.

FIG. 2 is a generalized schematic cross-sectional diagram illustrating major features of certain embodiments of dual output downlight fixture 100, FIG. 1. A polar coordinate system is shown that defines a vertical direction z, an azimuthal angle of rotation θ about the vertical axis, and a polar angle ϕ from the vertical axis; this coordinate system applies to all apparatus drawings herein. Downlight fixture 100 includes a housing 110 that defines at least a first cavity; in this embodiment the first cavity is divided into an inner, downwardly facing cavity 120 and an outer, downwardly facing cavity 130. A partition 140 at least partially separates inner cavity 120 and outer cavity 130, as shown. In this embodiment, a lower edge 145 of inner cavity 120 defines a first output aperture 150, while a lower edge 115 of housing 110 and lower edge 145 together define an annular second output aperture 160.

The term "output aperture" is used herein to mean a place at which light exits a downlight fixture, irrespective of whether that place is a physical opening or an optical component that is translucent or transparent, such as a cover, a diffuser or the like. The word "annular" is used herein to characterize a second output aperture or outer cavity that completely surrounds a respective first output aperture or inner cavity in an azimuthal direction, irrespective of an exact shape of the inner boundary, outer boundary, or shape of the respective apertures or cavities, and irrespective of a slope of a feature or aperture connecting two cavities. That is, although FIG. 2 may suggest that housing 110 and/or partition 140 form shapes that are circular in plan view, embodiments may form other shapes in plan view, such as ovals, ellipses, squares, rectangles, triangles and other polygons. When housing 110 and partition 140 are cylindrical, first output aperture 150 may be circular, and second output aperture 160 may be an annular, circular ring about first output aperture 150, but combinations of other shapes are also possible. For example, first output aperture 150 may be circular and a surrounding outline of second output aperture 160 may be elliptical, square, etc., in such cases second output aperture 160 remains "annular" herein. Also, in certain embodiments, partition 140 separating first output aperture 150 from second output aperture 160 may not be vertical, may not be equal in height to housing 110, and/or may not meet housing 110 at an uppermost inner surface of housing 110. In certain embodiments, partition 140 forms a reverse taper; that is, first output aperture 150 may be narrower than a diameter of partition 140 where it meets housing 110. In certain embodiments, a lower edge of partition 140 may not extend to the same level as lower edge 115 of housing 110, but may instead be higher or lower than lower edge 115. In all such cases the second output aperture 160 is considered "annular."

Dual output downlight fixture 100 includes a first light source 170 and one or more second light sources 172. Light sources 170 and 172 are illustrated schematically herein as packaged LEDs that emit light through typical, dome-shaped optics, but this is not necessary; in other embodiments, light sources 170 and/or 172 are unpackaged LED chips, packaged LEDs in other packages, or other types of light sources. First light source 170 provides task light 101, while second light source(s) 172 provide(s) ambient light 102, as shown (note the distributions of task light 101 and ambient light 102 in FIG. 2 are about the same as those shown in FIG. 1). A location and emission direction of first light source 170 define an optical axis 8. Optical axis 8 passes through a centroid of first light source 170 and extends toward nadir in FIG. 2, but the optical axis can tilt in certain embodiments (e.g., see FIGS. 8A-8G). First light source 170 and second light source(s) 172 may be individual light emitters or combinations of multiple light emitters of any type, although light emitting diode ("LED") light emitters are especially advantageous due to their compact size and efficiency. In particular, first light source 170 may be a light source formed of multiple LED chips within a single unit (sometimes called a "chip on board" source) while second light source 172 may include one or more LED chips on one or more circuit boards arranged along an inner top surface, or inner side surfaces, of housing 110. The inner top surface of housing 110 may be horizontal and/or orthogonal to optical axis 8, as shown in FIG. 2, or may be curved or slanted such that second light sources 172 mounted thereon emit toward a preferred direction. Inner surfaces of housing 110 are typically reflective to improve efficiency of light delivery from second light source 172. In certain embodiments, inner surfaces of partition 140 are reflective to improve efficiency of light delivery from first light source 170, while in other embodiments partition 140 is transparent or translucent so that high angle views of partition 140 (e.g., views from angles that are not within the distribution of task light 101) present a lighted appearance, as discussed below in connection with FIG. 6. Except as otherwise noted, surfaces described herein noted as reflective may be any of light colored or painted surfaces that provide moderate reflectance (e.g., 70%-90% reflectance), or may be surfaces of metal or optical materials, such as glass or plastic, that provide high reflectance (e.g., 90%-99% reflectance). High reflectance surfaces may include, without limitation, metals, metalized plastics or metalized glass, with or without reflection enhancing films. Reflective surfaces may be smooth and/or polished so as to provide specular reflections, or may have surface texture so as to provide diffuse reflections.

Figure 3:
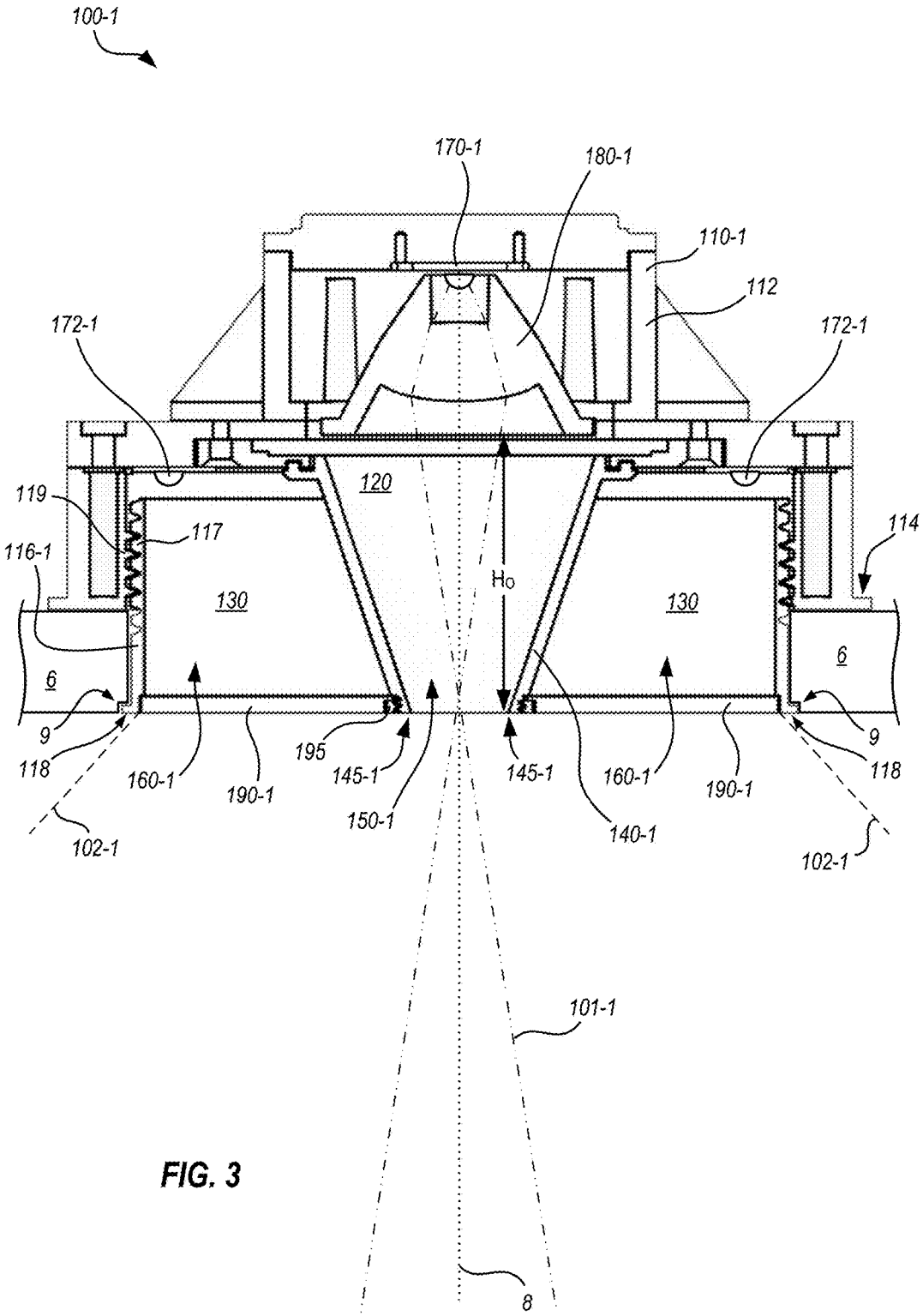
FIG. 3 is a schematic cross-sectional illustration of a dual output downlight fixture, in accord with an embodiment.
Figure 4:
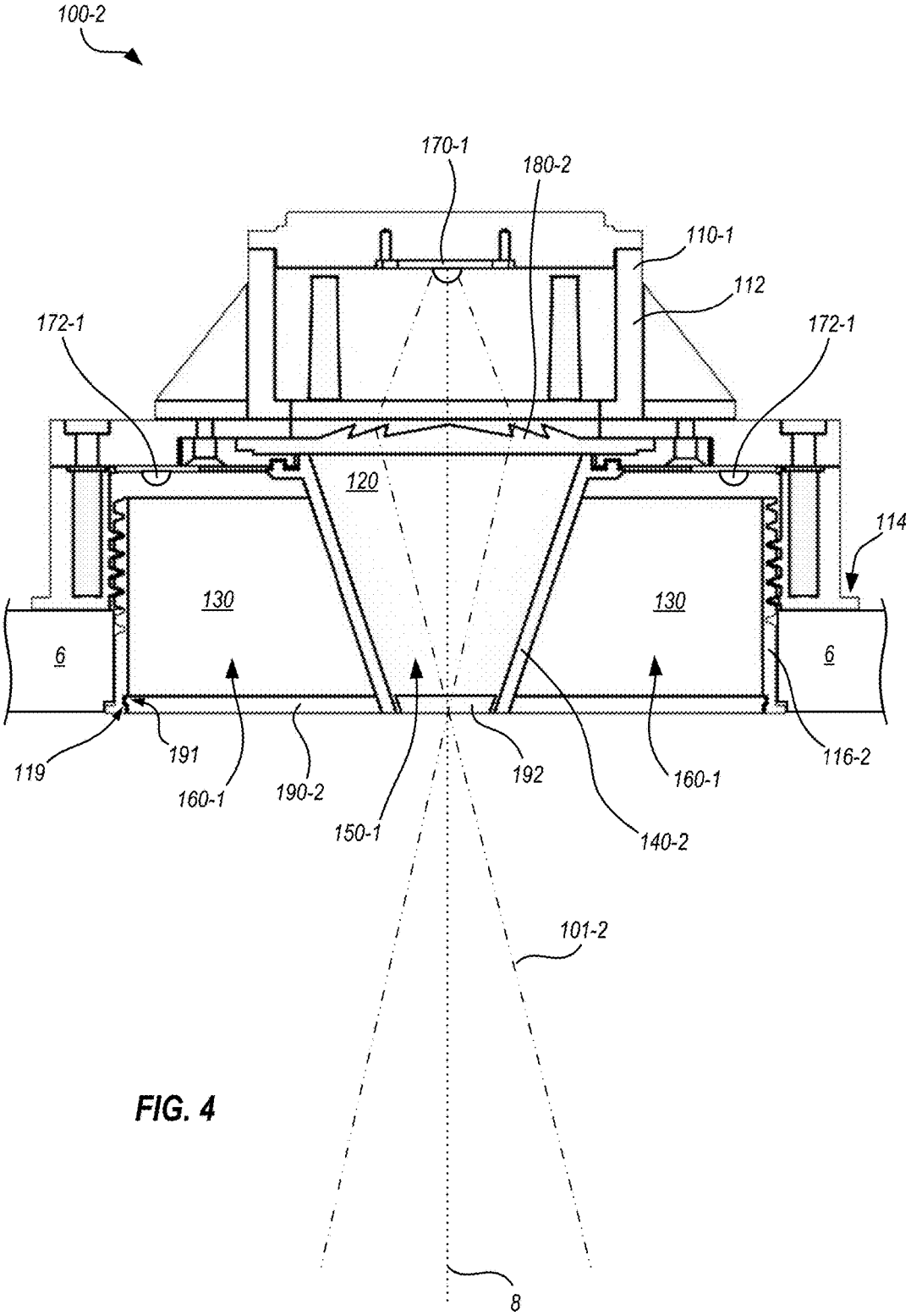
FIG. 4 is a schematic cross-sectional illustration of another dual output downlight fixture, in accord with an embodiment.

Because LED light sources are compact (e.g., as compared with typical incandescent and/or CFL light emitters) use of LED light sources advantageously enables dual output downlight fixtures 100 to be packaged into compact units having housings 110 with widths and heights as little as around 3.5 and 2.5 inches respectively (width and height of housing 110 being considered in connection with the orientation shown in FIGS. 2, 3 and 4 herein). The compact light source size provided by LEDs allows optic 180 to be small while providing the optical control needed to get light 101 out of aperture 150 efficiently, and limiting interaction of light 101 with partition 140. Also, the smooth dimming and instant-on nature of LEDs, along with the ability to do frequent switching and dimming without degrading life, make LEDs much better suited for products such as dual output downlight fixture 100, which may be targeted for a relatively high end, architectural lighting market. Still further, LEDs are generally reliable enough to be integrated permanently into light fixtures, as opposed to incandescent and/or CFL light emitters, that generally need to be designed for field replacement of the light emitter.

First light source 170 emits light 101 generally downwardly. Light 101 may be redirected by optional optics 180, shown as a lens in FIG. 2. Optional optics 180 may be refractive, reflective or both. In embodiments, optics 180 have positive optical power so as to redirect light 101 to form a converging beam (as illustrated in FIG. 2), while in other embodiments, optics form light 101 as a collimated beam or a diverging beam. In some embodiments, for example as illustrated in FIGS. 2-6, 7A, 7D, and 8A, partition 140 does not participate in the formation of the beam of light 101. Light 101 exits inner cavity 120 at output aperture 150. Certain embodiments combine optics 180 that form light 101 into a beam that converges near a height of lower edges 145 of partition 140. In certain ones of these and other embodiments, partition 140 tapers, to minimize area of aperture 150 and maximize area of aperture 160 (see, e.g., FIG. 3, discussed below). Certain embodiments do not include optics 180.

Certain embodiments herein couple light sources 170, 172 and other elements fixedly with respect to housing 110, but in certain embodiments, light 101 is aimable by mechanically adjusting position, polar and/or azimuthal angles of light source 170, which correspondingly changes the direction of optical axis 8 (e.g., see FIGS. 8A-8G). For example, optical axis 8 may be adjustable from nadir to up to 70 degrees from nadir, although angles of up to around 30 degrees from nadir would be most typical, and may be adjustable to any azimuthal direction in a full circle. One of ordinary skill in the art, upon reading and comprehending the present disclosure, will be able to practice not only the specifically described concepts, but will readily recognize alternatives, equivalents, modifications, and intermediate combinations of the disclosed features, all of which are within the scope of the disclosure.

Second light source(s) 172 emit light within outer cavity 130, such that light 102 exits through second output aperture 160. A diffuser 190 is typically located across second output aperture 160, although this is not required. When present in some embodiments, diffuser 190 sometimes does not extend downwardly beyond lower edge 145 of partition 140, so that light 102 and light 101 remain visibly separate, to an observer below. That is, lower edge 145 advantageously minimizes any optical "bleed through" of lights 101 and 102 across first and second output apertures 150 and 160. In other embodiments, diffuser 190 is continuous across first and second output apertures 150 and 160.

When present, diffuser 190 blocks a direct view of second light source(s) 172 from below, that is, diffuser 190 mixes second light 102 so that second light source(s) 172 are visually indistinguishable after second light 102 passes through diffuser 190, providing homogeneous light output for a sleek, uncluttered look. Although some embodiments may include relatively few (e.g., three to six) second light sources 172, in order to make second light sources 172 visually indistinguishable from one another, other embodiments use large numbers (e.g., 12, 24, 36, 60 or more) of second light sources 172. Second light sources may be arranged in one, two, or more rows. Diffuser 190 may also be formed of materials that preferentially allow low polar angle light output but limit high polar angle light output, so as to reduce glare. Light sources 172, and shapes, materials and/or optical properties of housing 110, partition 140 and diffuser 190 may be arranged so as to provide light 102 with a specific photometric distribution. In some embodiments, the photometric distribution of light 102 is approximately Lambertian in the far field, while in other embodiments high angle output (e.g., between 60 and 90 degrees from nadir) is reduced to lessen glare. In still other embodiments, the photometric distribution of light 102 is slightly reduced at low polar angles (e.g., around nadir) and slightly increased at moderate angles (e.g., in the range of 20 to 40 degree polar angles) in order to spread illumination about a larger area.

Light 101 is advantageously concentrated, by optics 180, geometry of partition 140 or both, within a small cone of output angles that can vary in embodiments. Light 101 typically provides a uniform, brightly lit region that subtends an angle $\phi_B$ of about 60 degrees or less, often about 10 to 30 degrees, as measured in the far field from aperture 150 (and, for example, measured at full width, half maximum intensity of light 101). Light source 170 and optics 180 may cooperate to form light 101 with sharp or diffuse edges.

Light sources 170 and 172 may be controlled by a single control switch and/or circuit, or may be controlled independently. For example, in the embodiment shown in FIG. 2, light source(s) 170 are controllable through connection 174, while light source(s) 172 are controllable through connection 176, independently of connection 174. Thus, dual output downlight fixture 100 can be controlled to provide task lighting alone (light 101), ambient lighting alone (light 102), or both. In embodiments, control of light sources 170 and 172 is limited to switching each light source on or off, while in other embodiments, either or both of light sources 170 and 172 can be dimmed independently to produce a wide variety of output combinations. Also, in some embodiments, connections 174 and 176 represent power supplied to the respective light sources 170 and 172 respectively, and operated by remotely located switching and/or dimming apparatus. In other embodiments, connections 174 and 176 represent control signals that activate light sources 170 and 172 respectively, for example by activating logic associated with light sources 170 and 172 (e.g., logic and/or drive current control circuits that may reside on circuit boards where light sources 170 and 172 are mounted). Control of light sources 170 and 172 may be implemented by wired or wireless controls. In some embodiments (particularly those where light fixture 100 replaces a previous light fixture that has only power wiring installed), light fixture 100 implements a wireless protocol such as IEEE 802.11 based communication ("WiFi"); Bluetooth Low Energy ("BLE"); 3G/4G wireless; low power, IEEE 802.15.4 based protocols, such as Zigbee and 6LoWPAN; or optical wireless communication. Conventional wireless receivers may be utilized to receive communications according to any of the above protocols, and to implement control of light sources 170 and/or 172 through connections 174 and 176.

FIG. 3 is a schematic cross-sectional illustration of an especially attractive and compact dual output downlight fixture 100-1. In downlight fixture 100-1, first light source 170-1 and second light source 172-1 are circuit boards into which appropriate LEDs (and/or chip-on-board type LED light sources) are coupled. Downlight fixture 100-1 also includes optic 180-1 that redirects light 101-1 into a converging beam, and features a radially symmetric, reverse-tapered partition 140-1 within a radially symmetric housing 110-1 (although in other embodiments, a partition 140 and/or a housing 110 need not be radially symmetric).

In downlight fixture 100-1, optics 180-1 form light 101-1 such that a beam waist occurs at about the height of lower edges 145-1 of partition 140-1, as shown schematically in FIG. 3. The illustrated cross-section of optics 180-1 are recognizable to one skilled in the art as a "TIR" refractor that uses total internal reflection to perform part or all of the shaping of light 101-1 into the illustrated beam. Other types of refractive and reflective optics may be used instead of TIR refractors, without limitation. In this and other embodiments herein, light 101-1 focuses to a point as shown, but focusing to a point is not strictly necessary. For example, light 101-1 may instead be focused by optics 180-1 to form a beam waist that is not a point, or be collimated, with lower edges 145-1 of partition 140-1 further limiting light 101-1. One skilled in the art, upon reading and comprehending the present disclosure, will readily recognize many possible variations, modifications and equivalents.

In certain embodiments, optics 180-1 at least form light 101-1 into a waist that is located within 75% to 125% of a vertical height $H_O$ from optic 180-1 to lower edges 145-1 (e.g., along optical axis 8). This enables first output aperture 150-1 to be relatively small, which has an aesthetically pleasing effect. In downlight fixture 100-1, with optics that form a small beam waist as shown in FIG. 3, a width (or diameter, in circular embodiments) of output aperture 150-1 is less than one-sixth of a width or diameter of output aperture 160-1. In other embodiments, a width or diameter of an output aperture 150 may be one-half, one-third, one-quarter, or less than one-sixth, of an outer width or diameter of a corresponding output aperture 160. The small area of aperture 150-1 allows the area of diffuser 190-1 to be relatively large, such that ambient light 102-1 is not perceived by a viewer as coming from a bright point source, but rather an area (ambient light 102-1 fills the area within the broken lines labeled 102-1). Task light 101-1 may be very bright, but because it is concentrated into a narrow, nearly vertical beam, it is not perceived as a bright point source (unless a viewer, who is within the small area where light 101-1 is concentrated, looks straight up at it). As noted above, LEDs are especially useful light sources for downlight fixture 100-1 because their small light-emitting areas can be mated with optics 180-1 that are similarly small in size, helping to facilitate a small size of output aperture 150 and a low overall cost of downlight fixture 100-1. A diffuser 190-1 seats within lower housing portion 116-1 and may be held thereto by a nut 195 that engages threads in a lower portion of partition 140-1, as shown.

FIG. 3 also illustrates a useful modality for installation of downlight fixture 100-1. Housing 110-1 is provided as an upper housing portion 112 and a lower housing portion 116-1 that couple threadedly, as shown. Upper housing portion 112 is open below second light source 172-1, while lower housing portion 116-1 is open above diffuser 190-1. An aperture is formed in ceiling 6 at the time of installation. A mounting flange 114 of upper housing portion 112 rests on an upper side of ceiling 6, generally outside the aperture, as shown. The aperture in ceiling 6 may form a square corner in cross section (e.g., a 90 degree edge relative to a lower surface of ceiling 6), or the corner may form a small recess 9 about a lower edge thereof, as shown. Lower housing portion 116-1 is brought into alignment with upper housing portion 112 above the ceiling, and a threaded portion 117 of lower housing portion 116-1 screws into a corresponding threaded portion 119 of upper housing portion 112 (it being understood that either portion 117 or 119 may form internal or external threads) until lower housing portion 116-1 seats against ceiling 6, as shown. As portion 116-1 screws into portion 112, the open regions of upper housing portion 112 below second light source 172-1, and of lower housing portion 116-1 above diffuser 190-1 adjoin to form cavity 130. When recess 9 about the lower edge of the ceiling aperture is present, a flange 118 of lower housing portion 116-1 fits into the recess, as shown in FIG. 3, providing a flush lower surface with ceiling 6.

FIG. 4 is a schematic cross-sectional illustration of another dual output downlight fixture 100-2 that includes slightly different features from downlight fixture 100-1. In general, the features of downlight fixture 100-2 are the same as the like-numbered features shown in downlight fixture 100-1, FIG. 3. Downlight fixture 100-2 includes Fresnel optics 180-2 that redirect light 101-2 into a converging beam. Downlight fixture 100-2 also includes a cover plate 192 within aperture 150-1; cover plate 192 may provide some amount of diffusion or may be a clear plate, and may simply rest within the reverse taper formed by partition 140-1, or may be coupled thereto by gluing or fastening in other ways. Cover plate 192 may be formed of the same or different material, and/or may have the same or a different surface finish, than diffuser 190-2. Diffuser 190-2 does not couple with partition 140-2 the way that diffuser 190-1 couples with partition 140-1 in FIG. 3; instead, diffuser 190-2 forms a rim 191 at an outer perimeter thereof, that snaps into a corresponding recess 119 formed by lower housing portion 116-2. Advantageously, a bottom surface of partition 140-2, diffuser 190-2 and cover plate 192 all lie in approximately the same plane (e.g., within about the thickness of either of diffuser 190-2 or cover plate 192) to provide a clean, flush look. Also, when partition 140-2 is opaque and is interposed between diffuser 190-2 and cover plate 192, optical "bleed through" (e.g., light propagating from one to another, as in a waveguide) from diffuser 190-2 to cover plate 192, or vice versa, is minimized. An ambient light emitted through diffuser 190-2 is not shown in FIG. 4 for clarity of illustration, but is similar in type and distribution to ambient light 102-1, FIG. 3.

Figure 5:
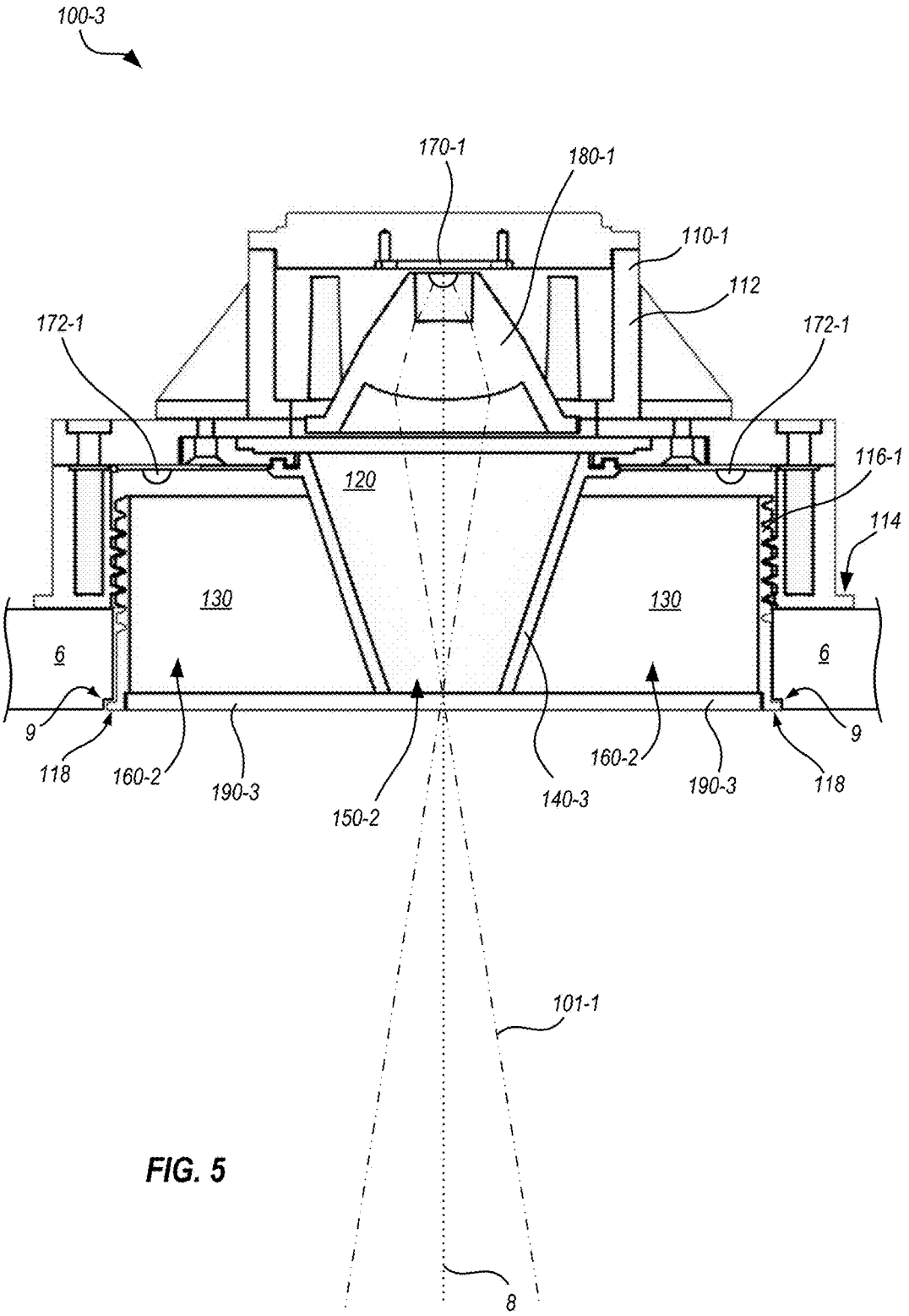
FIG. 5 is a schematic cross-sectional illustration of another dual output downlight fixture, in accord with an embodiment.

FIG. 5 is a schematic cross-sectional illustration of another dual output downlight fixture 100-3 that includes slightly different features from downlight fixtures 100-1 and 100-2. In general, the features of downlight fixture 100-3 are the same as the like-numbered features shown in downlight fixture 100-1, FIG. 3. Partition 140-3 is slightly shorter than partition 140-1, FIG. 3, so that a single cover plate 190-3 can span both apertures 150-2 and 160-2. Cover plate 190-3 may be either a clear or a diffuse plate, or may have differing characteristics in regions that correspond with apertures 150-2 and 160-2 respectively. Use of a single cover plate 190-3 may simplify manufacturing as well as provide aesthetically useful effects, as described below in connection with FIG. 6. Alternatively, in embodiments, cover plate 190-3 can be used in conjunction with diffusers over apertures 150-2, 160-2 to provide different optical effects. Cover plate 190-3 may be secured to downlight fixture 100-3 through an interference fit or snap fit onto lower housing portion 116-1, and/or by gluing to lower housing portion 116-1 and/or a bottom surface of partition 140-3. Because cover plate 190-3 is translucent or transparent, some optical "bleed through" may occur, but may be inconsequential if partition 140-3 is also translucent or transparent, as discussed below. An ambient light emitted through diffuser 190-3 is not shown in FIG. 5 for clarity of illustration, but is similar in type and distribution to ambient light 102-1, FIG. 3.

Figure 6:
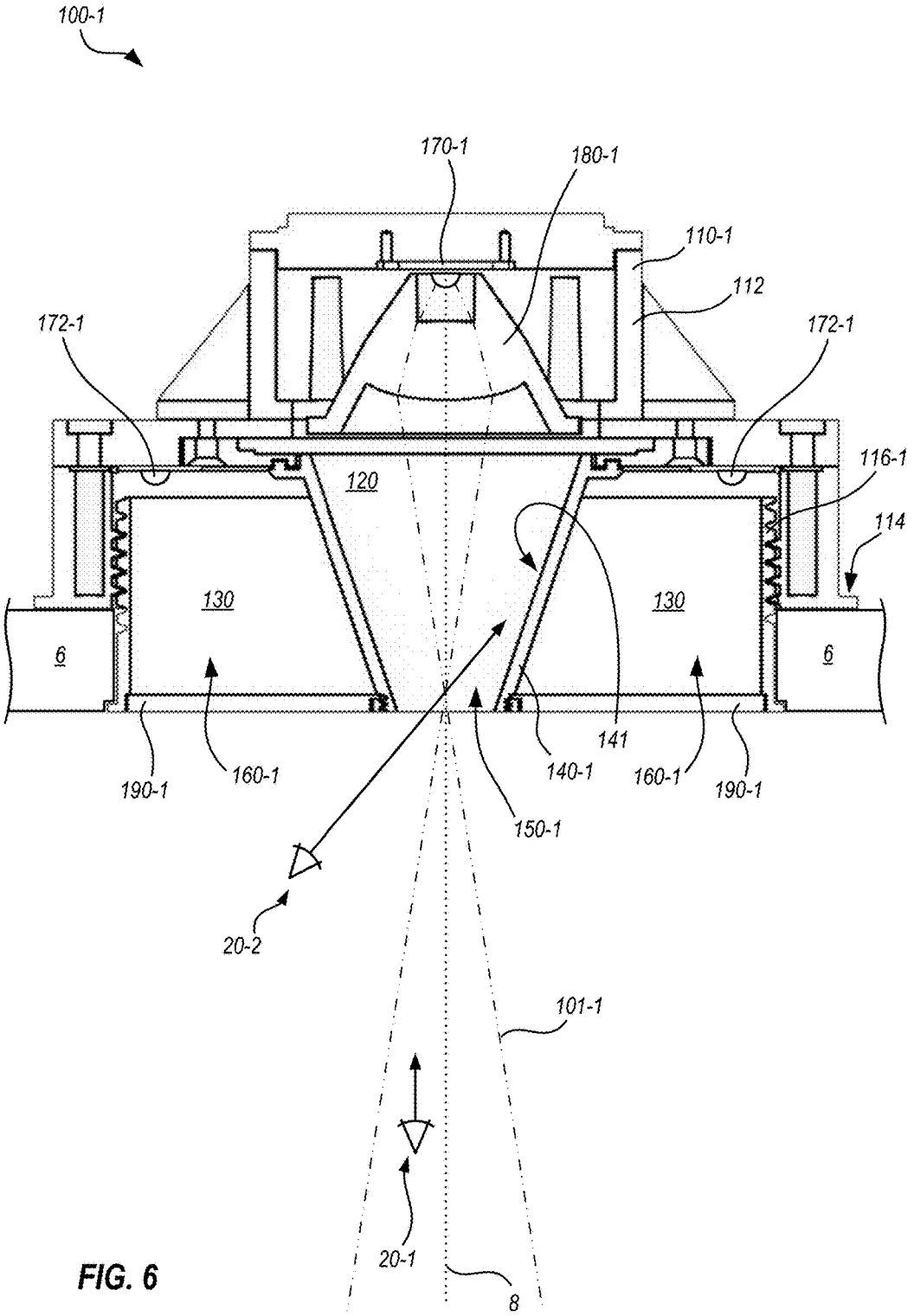
FIG. 6 is a schematic cross-sectional illustration of the dual output downlight fixture of FIG. 3, with different aspects labeled, in accord with an embodiment.

FIG. 6 is a schematic cross-sectional illustration of dual output downlight fixture 100-1, with different aspects labeled, to clearly illustrate certain aesthetic effects of material choices and finishes for partition 140-1. All features of downlight fixture 100-1 shown in FIG. 6 are understood to be the same as those shown in FIG. 3.

In FIG. 6, positions of viewers 20-1 and 20-2 looking towards downlight fixture 100-1 are identified; an arrow associated with each viewer 20 identifies a particular direction of view. Viewer 20-1 views downlight fixture 100-1 from about directly underneath, that is, within the distribution of light 101-1 from first light source 170-1. When light source 170-1 is turned on, light 101-1 is typically strong enough that viewer 20-1 will not notice or care about physical details that may be visible within aperture 150-1; viewer 20-1 will simply look away. Viewer 20-2, however, is not within the distribution of light 101-1 from first light source 170-1 and may be able to see an inner surface 141 of partition 140-1, as shown. Certain embodiments herein recognize that when inner surface 141 presents a purely reflective surface (e.g., a mirror surface that reflects all light), light that scatters toward viewer 20-2 will be a complicated function of the geometry of inner cavity 120 and optics 180-1, exact position of light source 170-1 within upper housing portion 112, and the like. Instead, it has been found advantageous to make partition 140-1 of a translucent or transparent material, so that light from cavity 130 passes into inner cavity 120 and is emitted toward viewer 20-2. This creates an aesthetically pleasing appearance wherein aperture 150-1 essentially blends into aperture 160-1. The result is that a viewer 20 that is anywhere outside the distribution of light 101-1 from first light source 170-1 sees what appears to be a uniform, flat aperture spanning the whole area of downlight fixture 100-1 that is visible from beneath. For this reason, certain embodiments may not include a partition 140. In other embodiments, partition 140 may be included primarily for structural purposes (e.g., to block contamination of diffuser 190-1 and/or other optical components).

Another variation on the possibility of partition 140-1 being transparent or translucent is that inner surface 141 of partition 140-1 may have a glossy inside surface such that any partial reflections off of the inside surface (e.g., Fresnel reflections) are specular. In this case, light from first light source 170-1 that impinges on inner surface 141 at a grazing local angle will continue to be reflected strongly therefrom, while light that impinges on inner surface 141 at a larger local angle will pass through partition 140-1 and will become part of the diffuse light within cavity 130. This leads to the effect that inner light source 170-1 can be either turned on strongly or turned off, without significant effect on the differences of diffuse light exiting apertures 150-1 and 190-1. That is, the entire lower surface of downlight fixture 100-1 may look somewhat brighter when inner light source 170-1 is on, and dimmer when it is off, but there will be little effect on the center-to-edge appearance thereof (again, except from the perspective of a viewer like viewer 20-1 within the distribution of light 101-1). Also, care may be taken to shield second light source 172-1 so that light emitted therefrom does not impinge directly on partition 140-1 or pass through aperture 150-1, but instead is diverted into cavity 130 to mix therein so that light exiting through aperture 150-1 is diffuse and at least approximately matched in luminous intensity with light exiting through aperture 160-1. The uniform appearance of apertures 150-1 and 160-1 that may be achieved by making partition 140-1 translucent or transparent also tends to obviate any need to avoid optical "bleed through" in diffusers spanning such apertures; that is, the visual effects of "bleed through" are inconsequential if cavities 130 and 120 emit about the same amount and type of diffuse light (e.g., not including task light 101, which is highly directional). Thus, when partition 140 is transparent or translucent, the lower edge of partition 140 and diffuser 190-1 shown in FIGS. 3 and 6 may be respectively replaced by a shorter version of partition 140 and a common diffuser 190-3 spanning both apertures 150 and 160, as shown in FIG. 5.

Further embodiments of dual mode downlight fixtures address tailoring photometric distributions, the ability to aim task or spot lighting independently of an area light (and independently of an installed orientation of a fixture), cost reduction, heat dissipation, glare control and other issues. Specific fixtures are described to illustrate some of these, and other, concepts. One of ordinary skill in the art, upon reading and comprehending the present disclosure, will be able to practice not only the specifically described concepts but will readily recognize alternatives, equivalents, modifications, and intermediate combinations of the disclosed features, all of which are within the scope of this disclosure.

Figure 7A:
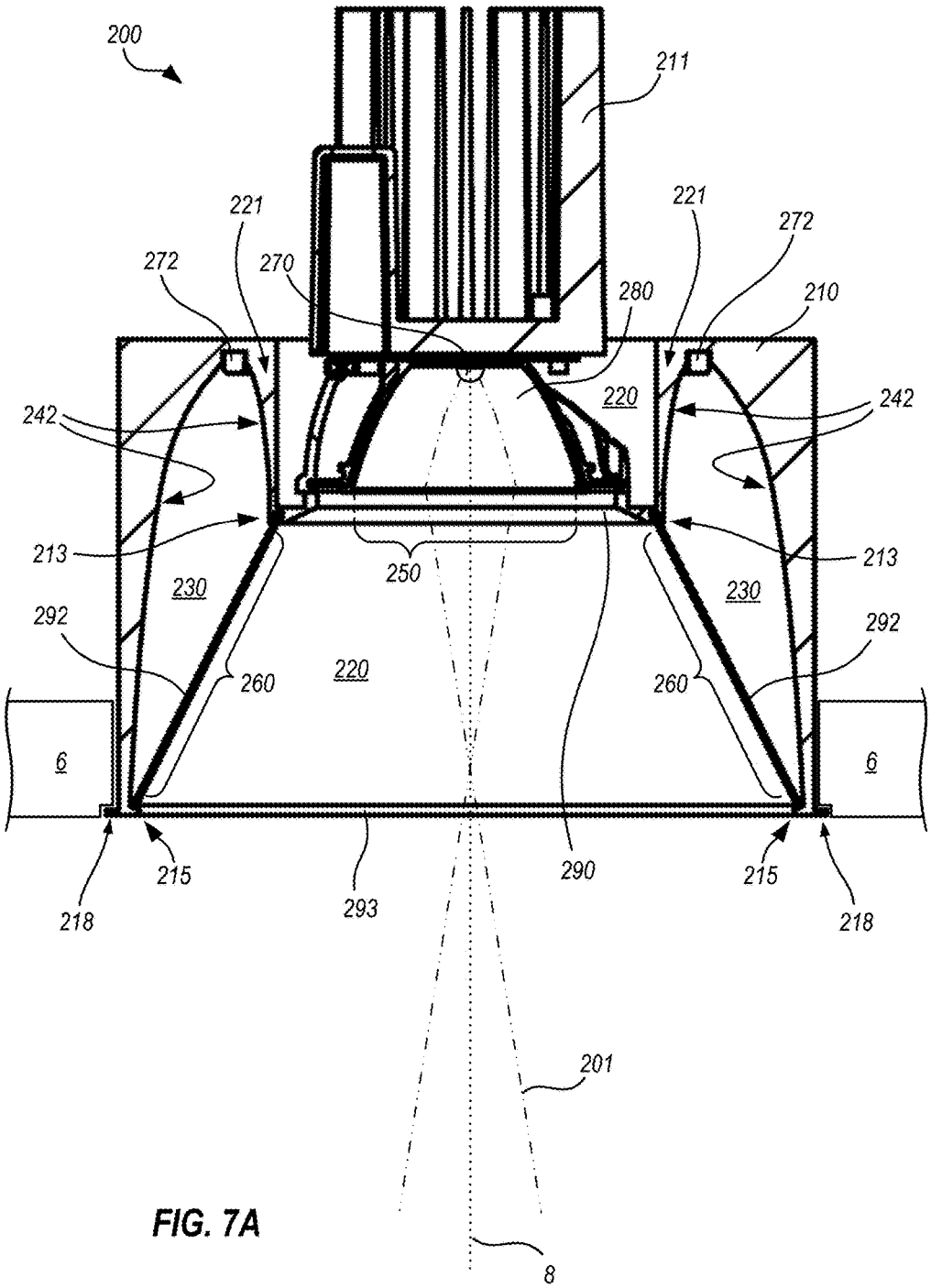
FIG. 7A is a cross-sectional view of another dual output downlight fixture, in accord with an embodiment.
Figure 7B:
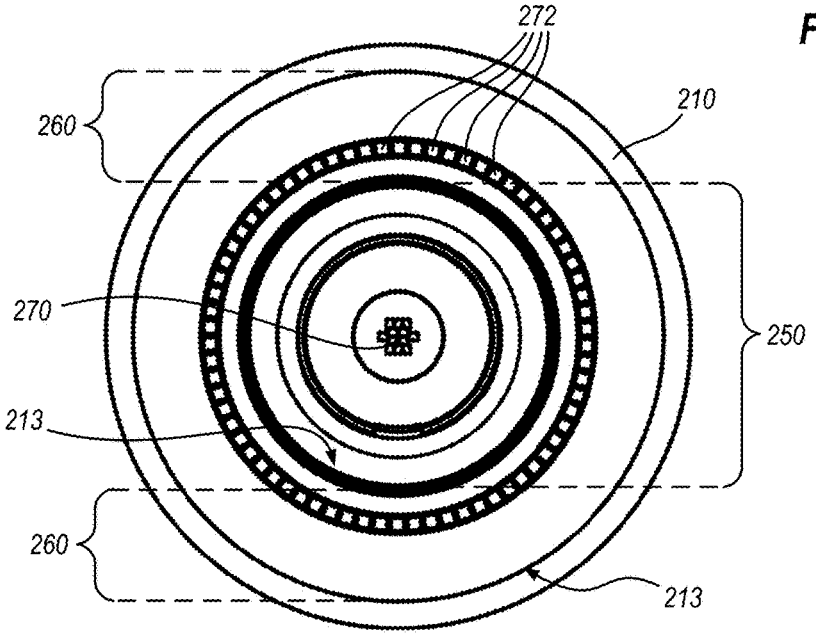
FIG. 7B is a bottom plan view of the dual output downlight fixture of FIG. 7A.
Figure 7C:
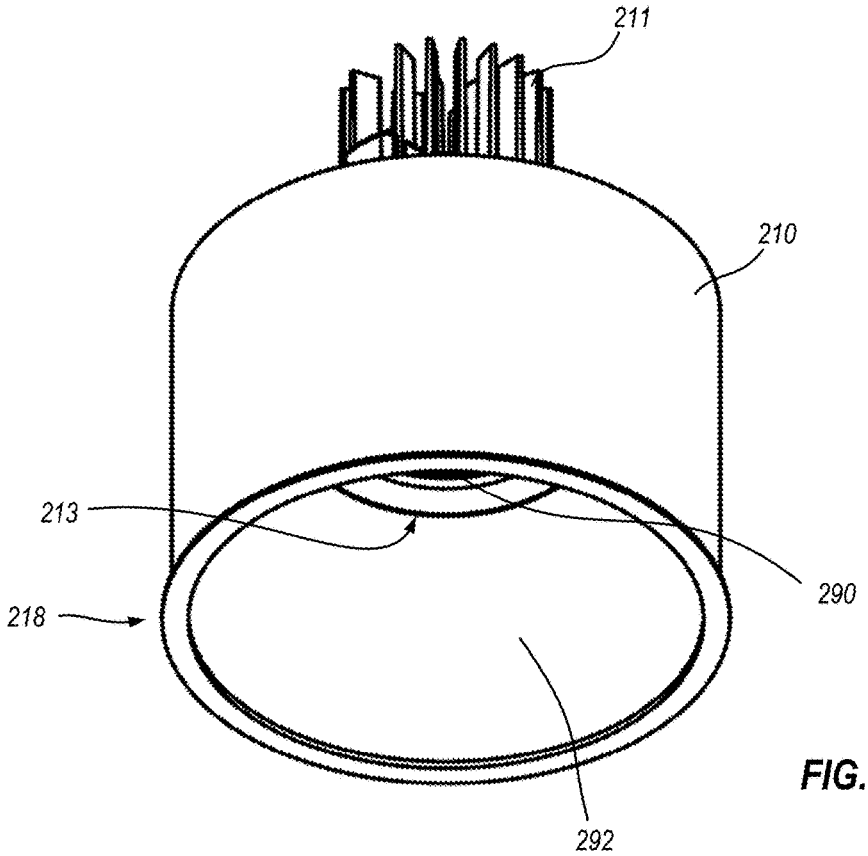
FIG. 7C is an isometric view of the dual output downlight fixture of FIG. 7A.
Figure 7D:
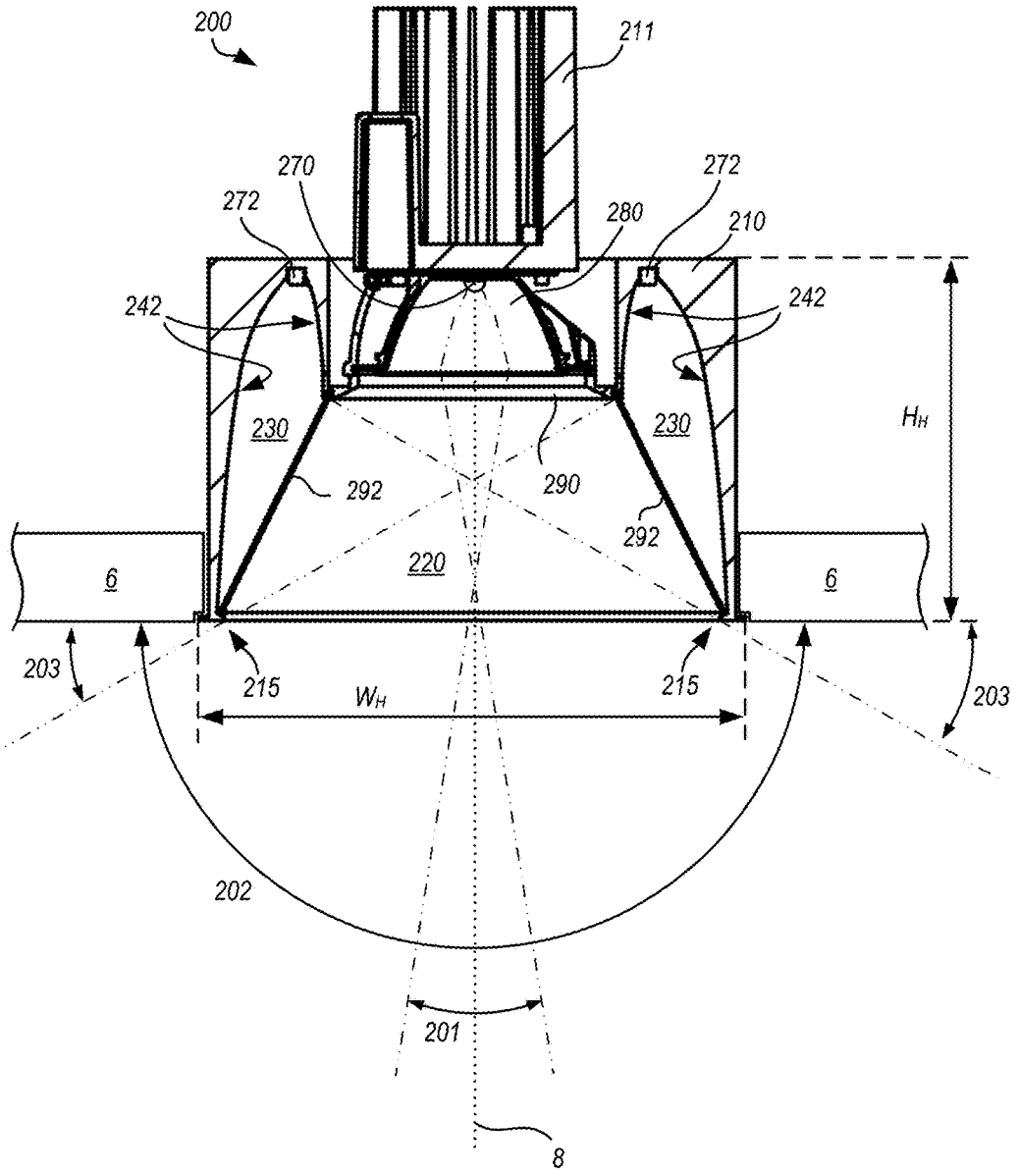
FIG. 7D is a second cross-sectional view of the dual output downlight fixture of FIG. 7A, with different labeling than FIG. 7A.

FIGS. 7A-7D are schematic illustrations of another attractive and compact dual output downlight fixture 200. FIG. 7A is a cross-sectional view, FIG. 7B is a bottom plan view, and FIG. 7C is an isometric view. FIG. 7D is a second cross-sectional view, with different labeling than FIG. 7A to better illustrate zones of illumination provided by fixture 200.

Fixture 200 includes a housing 210 that forms a central cavity 220 and an annular outer cavity 230. A portion 221 of housing 210 forms a partition between upper portions of central cavity 230 and central cavity 220, and an annular diffuser 292 separates lower portions of central cavity 220 and annular outer cavity 230. A first light source 270 atop or within central cavity 220 provides light 201 through an annular, first output aperture 250, and one or more second light sources 272 within annular outer cavity 230 provide light 202 through a second output aperture 260 (light 202 is labeled only in FIG. 7D). Light sources 270, 272 are advantageously LEDs due to their compact size, reducing an overall size of fixture 200.

An optic 280 shapes light from light source 270 for task lighting, that is, light 201 may be considered an example of light 101, lighting area 7, FIG. 1. Light shaping by optic 280 may take a variety of forms; for example, optic 280 may shape light 201 so as to form a far field spot distribution that has sharp edges, definite but not sharp edges, or diffuse edges, and a size, shape and/or type of edges of the spot may depend on distance and/or orientation of a far field surface relative to light fixture 200. Like light 101 discussed above, optic 280 may shape light 201 so as to form a waist that is a point, as shown in FIG. 7A, or a waist that is not a point, or no waist at all. Optic 280 may be any combination of reflective and/or refractive optics. For example, in certain embodiments optic 280 may simply be a reflector that collimates light 201 to some degree. In some of these and in other embodiments, optic 280 may include refractive optics, including but not limited to a TIR refractor (e.g., like optic 180-1, FIG. 3).

An optional diffuser or cover 290 may be present below optic 280, across all or a portion of first output aperture 250, as shown in FIG. 7A. Diffuser 290 may optionally provide one or more optical effects, and may be clear (e.g., transparent and non-diffusive) to highly diffusive (e.g., partially or completely randomizing direction of incident light 201) and from planar (e.g., not altering direction of incident light 201) to refractive and/or reflective (e.g., incorporating angled and/or reflective surfaces to alter direction of incident light 201). Using a clear cover as diffuser 290 may help to minimize high angle glare associated with light 201, as discussed below. Another optional diffuser or cover 293 may also be present across a lowermost extent of light fixture 200, at or about the plane of ceiling 6. When present, optional diffuser 293 is generally clear and non-diffusive so as not to interfere with directionality of lights 201, 202 as shaped by other features of fixture 200, as discussed below. Optional diffusers 290 and/or 293 also advantageously help protect other internal components of fixture 200 from handling damage and/or contamination. Optional diffusers 290, 292, 293 and optic 280 are not shown in the view of FIG. 7B to more clearly illustrate light sources 270, 272 within housing 210.

Second light sources 272 emit light 202 generally downwardly, that is, they may be aimed directly toward nadir, or downwardly but tilted, to customize a distribution of light 202. In certain embodiments, second light sources 272 are positioned so as to form a partial or complete ring at an apex of annular cavity 230 (e.g., as shown in FIG. 7B) but this is not required. Some of light 202 may reflect and/or diffuse from inner surfaces 242, which effects may be used to further modify distribution of light 202 as it exits second output aperture 260. For example, parameters such as a location and angle of second light sources 272, shape and/or reflectivity of inner surface 242 may be chosen so as to direct a significant amount of light 202 into diffuser 292 at a specific angular range relative to nadir. For example, light 202 may exit diffuser 292 and emit strongly from light fixture 200 within an angular range of 20 to 45 degrees from nadir. This outward "punch" helps light fixture 200 provide useful ambient light across a wide area, as compared with a typical (e.g., Lambertian) light distribution that forms a bright "pool" of light directly beneath a fixture but does not effectively light more distant areas. However, the same parameters of second light sources 272 and inner surface 242 can also be controlled to minimize light emitted at extremely high angles from nadir (e.g., 60 to 90 degrees from nadir) to minimize glare.

Light 202 passes through diffuser 292; like diffuser 290, diffuser 292 may be clear or diffusive, and/or may provide additional refractions or reflections to shape a distribution of light 202. In light fixture 200, diffuser 292 adjoins housing 210 at a lower, outer edge 215 and at an upper, annular region 213 that bounds outer cavity 230, however this is not required. That is, in other embodiments, diffuser 292 will obtain support from at least one location but may not adjoin a housing 210 in the manner shown, may not adjoin housing 210 at both its upper and lower edges, and/or may not adjoin housing 210 continuously along either or both of its upper and lower edges. One skilled in the art, upon reading and comprehending the present disclosure, will readily recognize many possible variations, modifications and equivalents.

Light fixture 200 as shown in FIGS. 7A, 7C and 7D includes a heat sink 211 to dissipate heat generated by light sources 270 and/or 272. Typically, heat sink 211 addresses dissipation of heat that is more of a concern for light source 270 than for light source 272, because light source 270 may include more, higher power and/or more densely packed LED devices than light source 272.

FIG. 7D illustrates height $H_H$ and width $W_H$ of housing 210, and an angular extent of first light 201, second light 202 and a low-glare region 203. First light 201 is controlled by optics 280 so as to be much brighter within the region illustrated in FIG. 7D, but incidental scattering from internal components, contamination, second-order reflections and the like will cause at least some light from light source 270 to be visible from any location that diffuser 290 is visible. This visibility is limited by the arrangement of lower edge 215 of housing 210 relative to diffuser 290, as shown. Height $H_H$ and width $W_H$ of housing 210 can thus be adjusted to control the extent of low-glare region 203. For example, a ratio of $H_H$ to $W_H$ is advantageously in the range of 0.4 to 1.0, to balance overall size of light fixture 200 with properties that affect the photometric distribution of light from fixture 200. For example, fixture 200 shown in FIGS. 7A-7D has a ratio of $H_H/W_H=0.75$. This allows annular cavity 230 to extend high enough so that inner surfaces 242 can reflect and/or diffuse light 202. This can enable light from individual LEDs forming light sources 272 to blend together so that diffuser 292 appears as a uniformly illuminating surface. The illustrated shape of housing 210 also facilitates a lower edge of housing 210 acting as a glare shield so that a very bright surface of optic 280 is not seen at high angles in low-glare region 203. In the example shown, low-glare region 203 extends about 30 degrees from horizontal. Lower values of $H_H/W_H$ can be used, but may tend to decrease the angular extent of low-glare region 203, and may result in individual light sources 272 being undesirably discernible behind diffuser 292. Higher values of $H_H/W_H$ may increase the angular extent of low-glare region 203, and reduce individual discernibility of light sources 272, but may increase an overall size of light fixture 200.

In related embodiments, a tilt and/or swivel mechanism (e.g., like tilt mechanism 317, FIGS. 8A, 8B) can be added to light fixture 200 so that tilt and/or azimuthal direction of optical axis 8 can be adjusted.

Figure 8A:
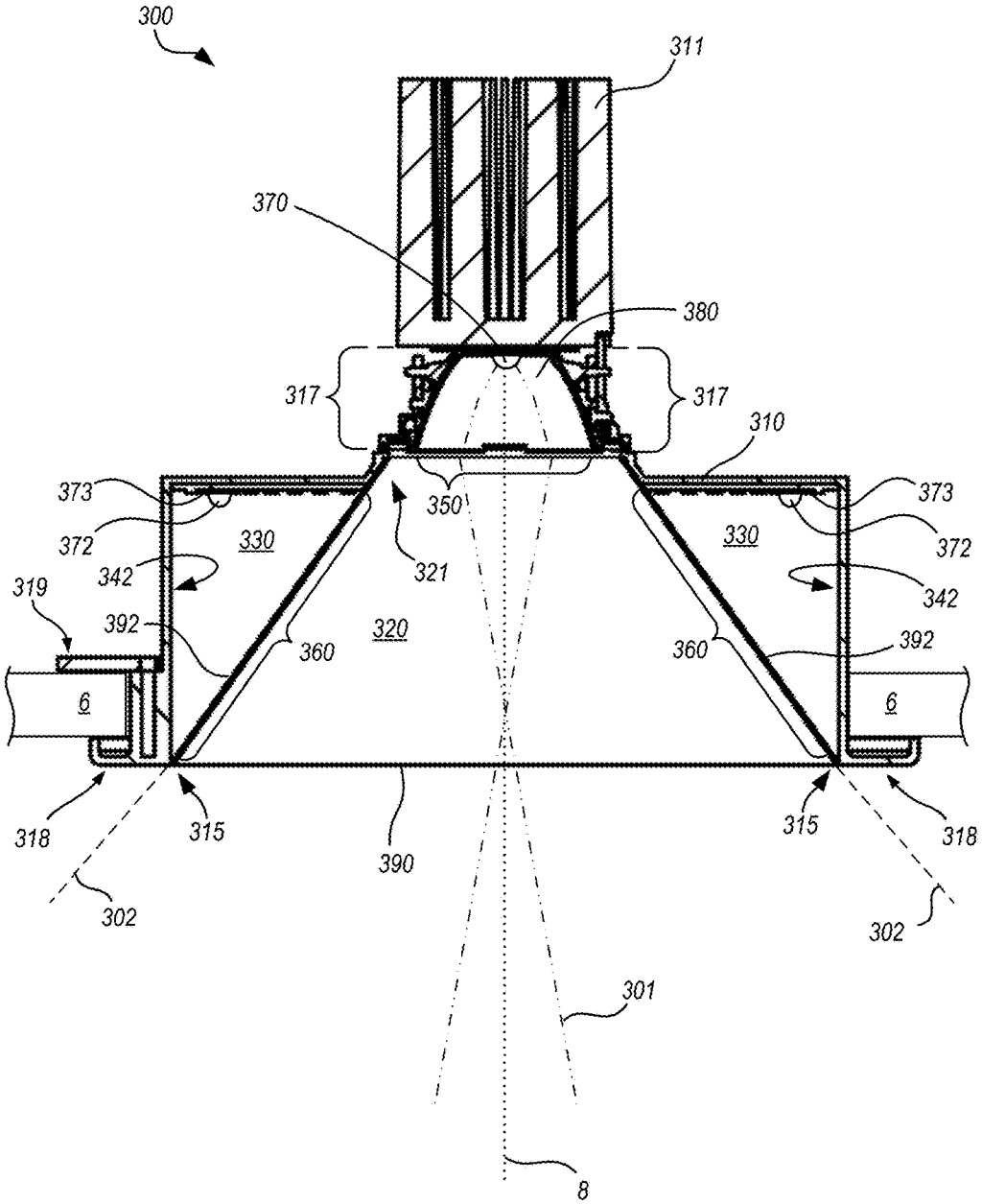
FIG. 8A is a cross-sectional view of another dual output downlight fixture, in accord with an embodiment.
Figure 8D:
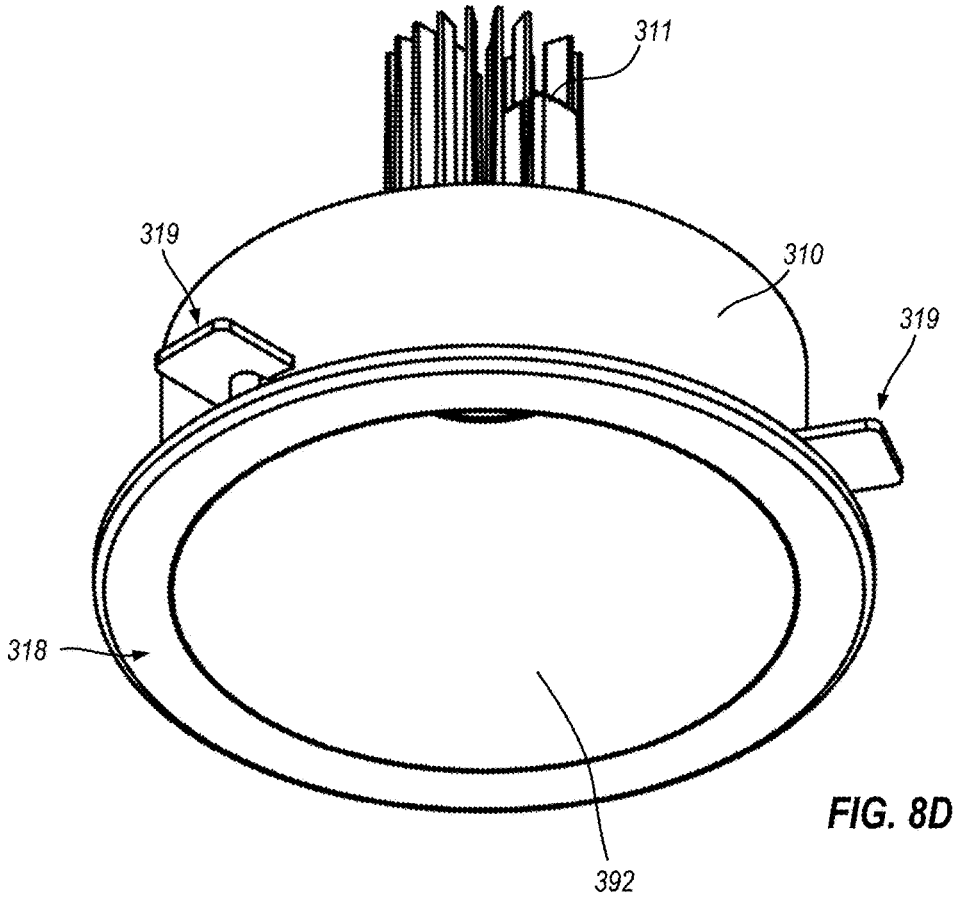
FIG. 8D is an isometric view of the dual output downlight fixture of FIG. 8A.
Figure 8E:
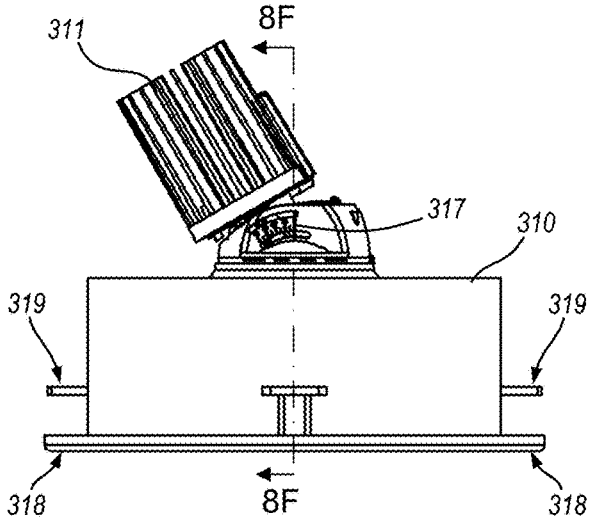
FIG. 8E is a front elevation of the dual output downlight fixture of FIG. 8A, with a first light source, an optic and a heat sink thereof tilted with respect to other features of the fixture.
Figure 8F:
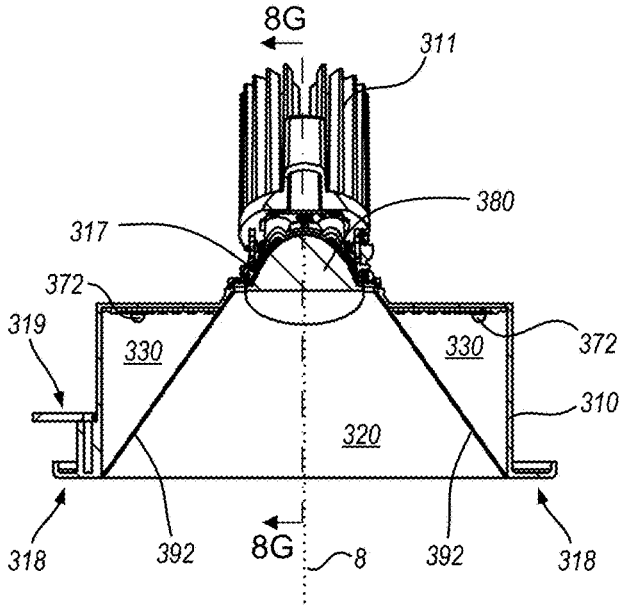
FIG. 8F is a cross-sectional view taken along line 8F-8F in FIG. 8E.
Figure 8G:
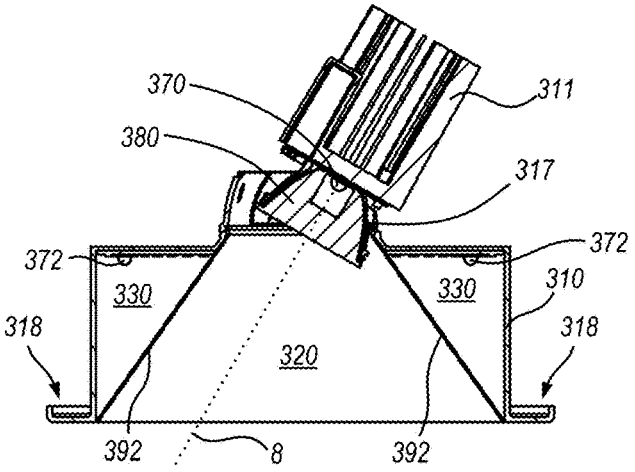
FIG. 8G is a cross-sectional view taken along line 8G-8G in FIG. 8F.

FIGS. 8A-8G are schematic illustrations of another attractive and compact dual output downlight fixture 300. FIG. 8A is a first cross-sectional view of fixture 300 installed within ceiling 6, FIG. 8B is a front elevation, FIG. 8C is a bottom plan view, and FIG. 8D is an isometric view. FIGS. 8E, 8F and 8G illustrate a first light source 370, an optic 380 and a heat sink 311 tilted with respect to other features of fixture 300. FIG. 8E is a front elevation, and FIGS. 8F and 8G are cross-sectional drawings taken across lines 8F-8F and 8G-8G in FIGS. 8E and 8F, respectively.

Fixture 300 includes a housing 310 that forms a central cavity 320 and an annular outer cavity 330, which are separated by an annular diffuser 392. A first light source 370 atop or within central cavity 320 provides light 301 through a first output aperture 350, and one or more second light sources 372 within annular outer cavity 330 provide light 302 through an annular second output aperture 360. Light sources 370, 372 are advantageously LEDs due to their compact size, reducing an overall size of fixture 300 and allowing placement of many light sources 372 so that light 302 is advantageously blended and uniform when viewed through diffuser 392. Embodiments herein typically include at least twelve light sources 372 arranged symmetrically within housing 310, but fewer or more, often many more, light sources 372 may be present. For example, FIG. 8C illustrates about sixty light sources 372 arranged in a uniform ring within housing 310. By comparing FIG. 8A with FIG. 8C it can be seen that a distance between light sources 372 and diffuser 392 is at least twice the distance between adjacent ones of light sources 372. In some embodiments, the ratio of distance between adjacent light sources 372 to a distance between light sources 372 and diffuser 394 can be four times or more. The ratio of distance between adjacent light sources 372 to distance between light sources 372 and diffuser 392, and properties of diffuser 392, can be varied to balance various optical properties such as uniformity, directionality and light transmission efficiency of emitted light 302.

Differences between dual output downlight fixture 300 and dual output downlight fixture 200 include a different shape of housing 310 relative to housing 210 (FIGS. 7A-7D), a different configuration of diffuser 392 relative to partition 221 and diffuser 292, and addition of a tilt adjustment mechanism 317 that can tilt and/or swivel (e.g., adjust polar and azimuthal angles) of first light source 370, optic 380, first output aperture 350 and heat sink 311 relative to the other features of fixture 300. The different shapes of housing 310 and diffuser 392, and the addition of tilt mechanism 317 lead to differences in the arrangement and qualities of first output aperture 350 and annular, second output aperture 360 relative to those of first output aperture 350 and annular, second output aperture 360. This listing of differences is not exhaustive, and one of ordinary skill in the art, upon reading and comprehending the present disclosure, will readily recognize further alternatives, equivalents, modifications, and intermediate combinations of features, all of which are within the scope of the disclosure. Lower edge 315 of housing 310, flange 318, inner surfaces 342 and second light sources 372 of fixture 300 are similar in function to congruently numbered items of fixture 200. One or more upper flanges 319 help secure fixture 300 to ceiling 6. The embodiment illustrated includes three upper flanges 319, but other embodiments may include more or fewer upper flanges 319; only one upper flange 319 crosses the cross-sectional plane illustrated in FIGS. 8A and 8F, while none cross the cross-sectional plane illustrated in FIG. 8G.

In light fixture 300, housing 310 provides a simplified optical arrangement for second light sources 372 generating light 302, relative to the similar features of light fixture 200. In one instance, second light sources 372 can be arranged on a PCB 373 that is easily mounted to a flat upper surface 319 of housing 310. From this location, second light sources 372 emit a first portion of light 302 toward diffuser 392, and a simple inner surface 342 of housing 310 reflects a second portion of light 302 that is initially emitted away from diffuser 392, back toward diffuser 392. Thus, if second light sources 372 are approximately Lambertian emitters, a substantial portion of light 302 will be either initially emitted or reflected so as to cross central cavity 320 and exit light fixture 300 azimuthally across from the second light sources 372 that initially provided the light 302. This helps light fixture 300 provide a photometric distribution that provides useful ambient light across a wide area. In some embodiments, though not shown in FIG. 8A, this effect can be further increased by sloping inner surface 342 of housing 310 inwardly near lower edge 315, so as to form a "kicker" surface to divert otherwise downwardly-traveling light, outwardly.

Another simplification is that diffuser 392 can be sized so that a smaller end of diffuser 392 (where the apex of the cone shape of diffuser 392 would be) can nestle into a recess 321 of housing 310, for simplicity during assembly of light fixture 300.

Adjustment mechanism 317 can adjust tilt and/or swivel (e.g., can adjust polar and/or azimuthal angles) of first light source 370, optic 380 and heat sink 311 relative to the other features of fixture 300. This enables redirection of first light 301 independently of light 302, for example to light a feature of architectural or artistic interest. Adjustment mechanism 317 can be any known type of tilt and/or swivel adjustment mechanism. In certain embodiments, after fixture 300 is installed, adjustment mechanism 317 can be adjusted from beneath (e.g., room side) by using a captivated screw type mechanism. This enables initial installation to be performed without azimuthal and/or polar alignment of fixture 300. Such angles can accordingly be adjusted later to provide spot highlighting for architectural or artistic objects of interest. FIG. 8E is a side elevation, and FIGS. 8F and 8G are cross-sectional drawings across different planes, illustrating first light source 370, optic 380 and heat sink 311 tilted. Of course, adjustment mechanism can be replaced, in embodiments, by brackets or other mechanisms that couple first light source 370, optic 380 and heat sink 311 in a fixed position relative to other features of fixture 300.

The foregoing is provided for purposes of illustrating, explaining, and describing various embodiments. Having described these embodiments, it will be recognized by those of skill in the art that various modifications, alternative constructions, and equivalents may be used without departing from the spirit of what is disclosed. Different arrangements of the components depicted in the drawings or described above, as well as additional components and steps not shown or described, are possible. Certain features and subcombinations of features disclosed herein are useful and may be employed without reference to other features and subcombinations. Additionally, a number of well-known processes and elements have not been described in order to avoid unnecessarily obscuring the embodiments. Embodiments have been described for illustrative and not restrictive purposes, and alternative embodiments will become apparent to readers of this patent. Accordingly, embodiments are not limited to those described above or depicted in the drawings, and various modifications can be made without departing from the scope of the claims below. Embodiments covered by this patent are defined by the claims below, and not by the brief summary and the detailed description.

What is claimed is:

1. A dual output downlight luminaire, comprising:

a housing that forms at least a first cavity;

a partition that extends from a portion of the housing and at least partially forms a boundary between the first cavity and an annular second cavity, wherein the partition is translucent or transparent;

a first light source that emits a first light, wherein the first light is centered about an optical axis and propagates toward a first output aperture;

an optic that redirects the first light to form a first light beam that exits the luminaire through the first output aperture, wherein a concentrated portion of the first light beam subtends an angle of 60 degrees or less and is centered about the optical axis, wherein the partition does not participate in the formation of the first light beam; and a plurality of second light sources, disposed within the second cavity, that emit a second light that exits the luminaire through an annular second output aperture;

wherein the first light source and the second light sources are independently controllable with respect to each other.

2. The dual output downlight luminaire of claim 1, wherein:

the first light source and the optic couple fixedly with the housing; and the first output aperture and the annular second output aperture are disposed symmetrically about the optical axis, the annular second output aperture being centered about the first output aperture.

3. The dual output downlight luminaire of claim 1, wherein the first light source and the optic couple with a mechanism capable of adjusting a polar angle of the optical axis with respect to the housing.

4. The dual output downlight luminaire of claim 3, wherein the mechanism is further capable of adjusting an azimuthal angle of the optical axis with respect to the housing.

5. The dual output downlight luminaire of claim 1, further comprising a diffuser disposed across the annular second output aperture.

6. The dual output downlight luminaire of claim 5, wherein:

the plurality of second light sources comprises at least twelve of the second light sources arranged symmetrically about the optical axis, a distance from the second light sources to the diffuser is at least twice a distance between adjacent ones of the second light sources, and the diffuser mixes the second light so that ones of the plurality of second light sources are visually indistinguishable after the second light passes through the diffuser.

7. The dual output downlight luminaire of claim 6, wherein:

the plurality of second light sources comprises at least twenty-four of the second light sources.

8. The dual output downlight luminaire of claim 5, wherein one or more internal surfaces of the housing are reflective so as to reflect portions of the second light from the second light sources toward the diffuser.

9. The dual output downlight luminaire of claim 5, wherein the diffuser is the partition.

10. The dual output downlight luminaire of claim 9, wherein:

the second light sources are disposed on a surface of the housing that is orthogonal to the optical axis, and the diffuser slopes outwardly from the surface of the housing that is orthogonal to the optical axis, to a periphery of the housing, such that the diffuser and the housing collectively enclose the second cavity.

11. The dual output downlight luminaire of claim 5, wherein:

the partition is integrated with the housing, the partition extends from the portion of the housing along a direction of the optical axis so as to optically separate a portion of the first cavity that includes the first light source, from a portion of the second cavity that includes the second light sources, and the diffuser extends outwardly from a lower edge of the partition to a periphery of the housing.

12. The dual output downlight luminaire of claim 11, wherein:

the partition extends along the direction of the optical axis for a first distance from an apex of the second cavity to the lower edge of the partition, and the housing extends along the direction of the optical axis for a second distance from the apex of the second cavity to the periphery of the housing to which the diffuser extends, the second distance being at least twice the first distance.

13. The dual output downlight luminaire of claim 11, wherein a surface of the partition that faces away from the optical axis is partially reflective so as to reflect portions of the second light from the second light sources toward the diffuser.

14. The dual output downlight luminaire of claim 11, further comprising a heat sink in thermal communication with the first light source.

15. The dual output downlight luminaire of claim 14, wherein the heat sink is also in thermal communication with the second light sources.

16. The dual output downlight luminaire of claim 11, wherein:

the first output aperture and the annular second output aperture are each symmetrical with respect to one or more directions orthogonal to the optical axis; and the first output aperture and the annular second output aperture are centered about the optical axis.

17. The dual output downlight luminaire of claim 11, wherein a lower periphery of the diffuser couples continuously with the housing along the periphery of the housing, and an upper periphery of the diffuser couples continuously along the lower edge of the partition, such that the second cavity is enclosed above the diffuser and below the housing.

18. The dual output downlight luminaire of claim 5, wherein a lower edge of the housing and a lower edge of the partition are substantially coplanar.

19. The dual output downlight luminaire of claim 18, wherein the diffuser is substantially coplanar with the lower edge of the housing and the lower edge of the partition.

20. The dual output downlight luminaire of claim 18, wherein the housing includes structure for mounting within a ceiling and is arranged such that when the housing is coupled with the ceiling, the diffuser, the lower edge of the partition and the lower edge of the housing are substantially coplanar with the ceiling.

21. A dual output downlight luminaire, comprising:

a housing that forms at least a first cavity;

a translucent or transparent partition that extends from a portion of the housing and at least partially forms a boundary between the first cavity and an annular second cavity;

a first light source that emits a first light, wherein the first light is centered about an optical axis and propagates toward a first output aperture;

an optic that redirects the first light to form a first light beam that exits the luminaire through the first output aperture, wherein a concentrated portion of the first light beam subtends an angle of 60 degrees or less and is centered about the optical axis, wherein the partition does not participate in the formation of the first light beam;

a plurality of second light sources, disposed within the second cavity, that emit a second light that exits the luminaire through an annular second output aperture;

a diffuser disposed across the annular second output aperture;

wherein the housing includes structure for mounting within a ceiling and is arranged such that when the housing is coupled with the ceiling, the diffuser, the lower edge of the partition and the lower edge of the housing are substantially coplanar with the ceiling;

wherein the first light source and the second light sources are independently controllable with respect to each other; and wherein the partition defines a first width where it extends from the portion of the housing, and tapers inwardly therefrom so as to define a second width at the first output aperture, the second width being less than the first width.

22. The dual output downlight luminaire of claim 21, wherein the second width is less than one-fourth of an outer width of the annular second output aperture.

23. The dual output downlight of claim 18, wherein the optic has positive optical power so as to form a waist in the first light beam.

24. The dual output downlight luminaire of claim 23, wherein the waist forms within a range of 75% to 125% of a distance along the optical axis from the optic to the first output aperture.

25. A method of providing one or both of task and ambient lighting using a single luminaire, comprising:

emitting a first light from a first light source toward a first output aperture of the single luminaire, wherein a light emission direction of the first light from a centroid of the first light source toward a centroid of the first output aperture defines an optical axis;

redirecting the first light with an optic to form a first light beam that exits the single luminaire through the first output aperture, such that a concentrated portion of the first light beam subtends an angle of 60 degrees or less, and is centered about the optical axis;

emitting a second light from a plurality of second light sources toward an annular second output aperture of the single luminaire, wherein the annular second output aperture azimuthally surrounds the first output aperture; and independently controlling the first light source and the second light sources, such that the first light beam is available when desired for task lighting and the second light is available when desired for ambient lighting, wherein the first output aperture is surrounded by a translucent or transparent partition that extends from the first output aperture toward the optic and surrounds the beam of light, and wherein the second light sources are disposed outside of the translucent or transparent partition, and wherein the translucent or transparent partition does not participate in the formation of the first light beam.

* * * * *